US010265715B2

(12) United States Patent
Bloc

(10) Patent No.: US 10,265,715 B2
(45) Date of Patent: Apr. 23, 2019

(54) SYSTEM FOR DISPENSING A FLUID PRODUCT

(71) Applicant: ALBEA LE TREPORT, Le Treport (FR)

(72) Inventor: Richard Bloc, Derchigny-Graincourt (FR)

(73) Assignee: ALBEA LE TREPORT, Le Treport (FR)

( * ) Notice: Subject to any disclaimer, the term of this patent is extended or adjusted under 35 U.S.C. 154(b) by 0 days.

(21) Appl. No.: 14/967,494

(22) Filed: Dec. 14, 2015

(65) Prior Publication Data

US 2016/0175864 A1 Jun. 23, 2016

(30) Foreign Application Priority Data

Dec. 23, 2014 (FR) ..... 14 63290

(51) Int. Cl.
*B05B 11/00* (2006.01)

(52) U.S. Cl.
CPC ..... *B05B 11/0044* (2018.08); *B05B 11/0013* (2013.01); *B05B 11/0097* (2013.01); *B05B 11/00412* (2018.08); *B05B 11/3047* (2013.01)

(58) Field of Classification Search
CPC ..... B05B 11/0016; B05B 11/0013; B05B 11/0043
USPC ..... 222/105
See application file for complete search history.

(56) References Cited

U.S. PATENT DOCUMENTS 4,457,455 A * 7/1984 Meshberg ..... B05B 11/0043 222/105
5,433,347 A * 7/1995 Richter ..... B65D 1/0215 222/105
9,132,443 B2 * 9/2015 Brahim ..... B05B 11/3047
2004/0124212 A1 * 7/2004 Masuda ..... B05B 11/0013 222/183

(Continued)

FOREIGN PATENT DOCUMENTS

FR 2685285 A1 6/1993
FR 2915248 A1 10/2008

(Continued)

OTHER PUBLICATIONS

Machine Translation of JP 7223663 from WIPOm "www.wipo.int".*
France App No. 1463290, International Search Report, dated Jul. 7, 2015.

*Primary Examiner* — Jeremy Carroll
(74) *Attorney, Agent, or Firm* — Banner & Witcoff, Ltd.

(57) ABSTRACT

A bottle comprises a container surmounted by a neck and an outer structural wall, having a membrane arranged on the inner surface to form a flexible pocket for containing product. A dispensing member intended to be mounted in the neck to be in communication with the container to be supplied with product. The member provided with a lower sealing crown arranged to be able to slide into the neck during mounting of said member, making it possible for excess air and product to be evacuated into an upper dead volume. The neck comprising a base having a narrow portion of which the inner dimension is such that, after the dispensing member is mounted, the lower crown comes into sealing interference on the portion of the membrane arranged in the region of said narrow portion so as to create (Continued)

a seal between the inside of said container and the dead volume.

10 Claims, 3 Drawing Sheets

(56) References Cited

U.S. PATENT DOCUMENTS

2009/0057347 A1* 3/2009 Leys ..... B65D 83/0055
222/386.5

FOREIGN PATENT DOCUMENTS

| | | | |
|---|---|---|---|
| FR | 2955842 | A1 | 8/2011 |
| JP | 07223663 | | 8/1995 |
| JP | 08133322 | | 5/1996 |

* cited by examiner

SYSTEM FOR DISPENSING A FLUID PRODUCT

CROSS REFERENCE TO RELATED APPLICATIONS

This application claims priority to French Application Serial No. 1463290, filed Dec. 23, 2014, which is hereby incorporated by reference in its entirety.

FIELD

The invention relates to a system for dispensing a fluid product, in particular a gel or a cream, for example a cosmetic product or a pharmaceutical product.

The dispensing system comprises a bottle having a container for packaging the product and a dispensing member which is mounted on said bottle so as to be in communication with said container in order to be supplied with product. In particular, the container is surmounted by an access neck in which the dispensing member is mounted by means of sliding until sealed in order to allow dispensing.

BACKGROUND

Bottles are known which comprise an outer structural wall, on the inner surface of which a membrane is arranged in so as to form a flexible pocket for containing said product. In order to protect the product well from any degradation upon contact with the external environment, the product can be packaged in the pocket in the absence of air (commonly referred to as "airless"), and the member is capable of ensuring that the packaged product is dispensed without take-up of air so that, during use, air does not enter the pocket to compensate for the dispensed product.

EP-0 571 280 describes the use of a bleed ring which is interposed between the lower portion of a dispensing pump and the container, making communication possible between said pump and the packaged product. In particular, the ring is arranged so as to be able to slide into the container during mounting of the pump, allowing excess air and product to be evacuated into an upper dead volume.

Thus, in particular taking account of the filling tolerances of the container, it is possible to mount the pump on the bottle while avoiding the presence of air bubbles in said container, in order to prevent degradation of the product and/or unpriming of the pump.

Nonetheless, it is possible that the sealing may not be sufficiently reliable after the pump has been mounted, in particular in relation to stringent demands in terms of protecting the product from any degradation upon contact with the external environment.

SUMMARY

The problem addressed by the invention is that of improving the prior art, in particular by proposing a dispensing system in which the dispensing member can be mounted in the neck of a container comprising a flexible pocket while ensuring an absence of air in said pocket, while also ensuring the reliability of the sealing of said mounting.

For this purpose, the invention proposes a system for dispensing a fluid product, comprising a bottle having a container for packaging said product which is surmounted by a neck for accessing said container, said bottle comprising an outer structural wall, on the inner surface of which a membrane is arranged so as to form a flexible pocket for containing said product, said system comprising a dispensing member which is intended to be mounted in the neck so as to be in communication with the container in order to be supplied with product, said member being provided with a lower sealing crown which is arranged so as to be able to slide into the neck during mounting of said member, making it possible for excess air and product to be evacuated into an upper dead volume, the neck comprising a base having a narrow portion of which the inner dimension is such that, after the dispensing member has been mounted, the lower crown comes into sealing interference on the portion of the membrane which is arranged in the region of said narrow portion so as to create a seal between the inside of said container and said dead volume.

BRIEF DESCRIPTION OF THE DRAWINGS

Other objects and advantages of the invention will become apparent in the following description, given with reference to the accompanying drawings, in which.

DETAILED DESCRIPTION

Figure 1:
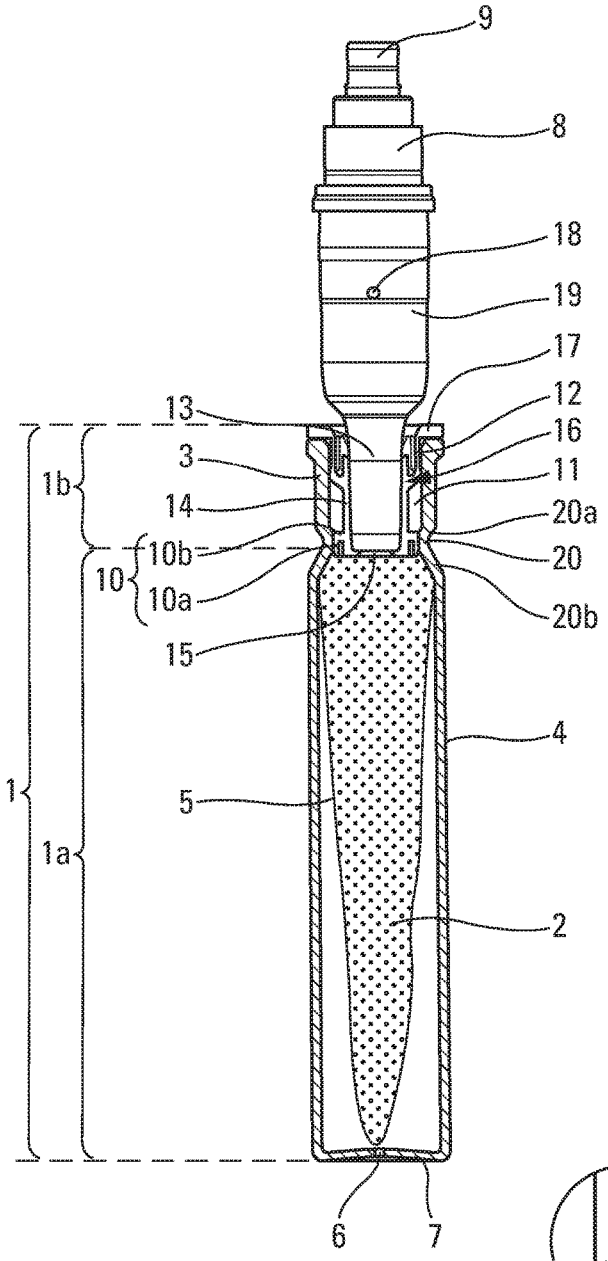
FIG. 1 shows part of a dispensing system according to an embodiment of the invention, in which a pump is shown mounted on the neck of a bottle during use, FIG. 1*a* being an enlargement of the upper portion of the bottle.

In the following, a system for dispensing a fluid product is described with reference to the drawings, it being possible for said fluid product to be a gel or a cream, for example a cosmetic product or a pharmaceutical product. In the description, the terms relating to positioning in space are understood with reference to the position of the system shown in the drawings.

In particular, the dispensing system may be of the same type as that described in FR-2 978 020, for example in order to make it possible to apply a product such as a liquid lipstick (lip gloss) or a lip care product.

The dispensing system comprises a bottle 1 which has a container 2 for packaging said fluid product, said container being surmounted by a neck 3 which is arranged so as to make it possible to access said container, in particular so as to pour the fluid product therein which is to be packaged, and/or to dispense the fluid product which is packaged therein.

With reference to the drawings, the bottle 1 comprises a cylindrical tube 1*a* in which the container 2 for packaging the product is formed, said tube being surmounted by an upper ring 1*b* having a reduced outer dimension and in which the neck 3 is formed.

The bottle 1 comprises an outer structural wall 4, on the inside of which a membrane 5 is arranged in order to form a flexible pocket for containing the fluid product.

In particular, the outer structural wall 4 is produced from a rigid thermoplastic material such as polypropylene. Furthermore, the membrane 5 is produced from a flexible plastics material, which is in particular polyethylene-based.

Advantageously, the bottle 1 is produced by means of blown coextrusion of the wall 4 and the membrane 5, not only so as to easily provide said bottle with the desired shape, but also so as to press the membrane 5 onto the inner surface of said wall in order to provide said wall with dimensions similar to the dimensions of said inner surface. Thus, when the membrane 5 is filled with fluid product, it forms a flexible pocket which substantially fits closely to the inner surface of the structural wall 4.

Figure 1A:
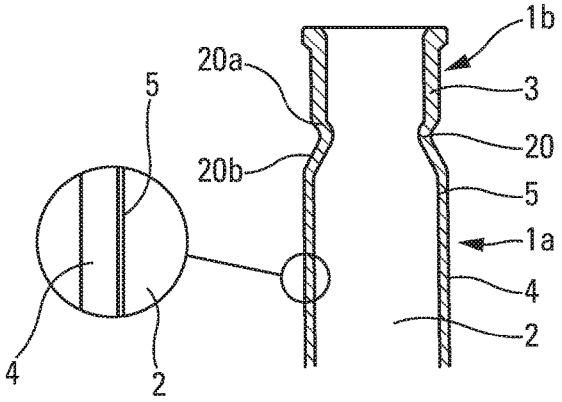

Moreover, as shown in FIG. 1*a*, the membrane 5 is detached from the structural wall 4. According to one embodiment, the membrane 5 has an outer layer formed of ethylene vinyl alcohol (EVOH) which permits detachment of this kind from a wall 4 formed of polypropylene.

Thus, during airless filling and dispensing of the product without air take-up, the pocket can retract into the wall 4 as said dispensing progresses (FIG. 1). Furthermore, the structural wall 4 has an opening 6 for allowing retraction of this kind, said opening being formed, for example, on the bottom 7 of the cylindrical tube 1*a*.

The dispensing system comprises a dispensing member 8 which is intended to be mounted in the neck 3, in particular after the flexible pocket has been filled with fluid product, so as to be in communication with the container 2 in order to be supplied with product.

In the embodiment shown, the dispensing member 8 is a pump, the body of which is provided with a nozzle 9 which is intended to be actuated in translation, in particular by means of a push button (not shown), so as to make it possible for the product to be dispensed.

In particular, the dispensing member 8 is provided with a lower sealing crown 10 which is arranged so as to be able to slide into the neck 3 during mounting of said member, allowing excess air and product to be evacuated into an upper dead volume 11.

Thus, the dispensing member 8 can be mounted on the bottle 1 while avoiding the presence of air bubbles in the container 2, in order to prevent degradation of the product and/or unpriming of said member. Furthermore, the mounting makes it possible to take account of the filling tolerances of the container 2 by evacuating, together with the air, any excess product which may have been poured into the container 2.

In the embodiment shown, the dispensing system comprises a collar 12 which is connected around the lower portion 13 of the dispensing member 8 and which supports the lower sealing crown 10. In particular, the collar 12 has a central well 14, in which the lower portion 13 of the body of the dispensing member 8 is mounted so as to be in clamping and sealed contact, the lower sealing crown 10 being formed around a lower end of said central well.

The central well 14 comprises a bottom which is provided with a lower opening 15, opposite which an opening of the lower portion 13 of the dispensing member 8 is arranged, so as to make it possible for the dispensing member 8 to be supplied via said openings when said member is mounted on the bottle 1.

In addition, the collar 12 has an upper crown 16 which is formed around the upper end of the central well 14, said upper crown being arranged so as to ensure sealing of the mounting by interference in the neck 3, the dead volume 11 being formed between said upper crown and the lower crown 10.

Moreover, the collar 12 has an upper rim 17 which extends radially from the upper end of the upper crown 16, said rim being intended to come into axial abutment against the upper wall of the neck 3 after the member 8 has been mounted in said neck.

Advantageously, the dispensing member 8 is of the kind which does not take up air in order to compensate for the volume of the dispensed product, in order not to allow air to enter the container 2 during use of the system, and to thus protect the product from any degradation upon contact with the external environment.

With reference to the drawings, the collar 12 is arranged so as to position only the lower portion 13 of the dispensing member 8 in the neck 3, the upper portion 19 of said member, on which the vent opening 18 is formed, remaining outside said neck and moreover being isolated from the container 2 on account of the sealing crowns 10, 16.

In order to ensure good sealing of the mounting, the neck 3 comprises a base which has a narrow portion 20, the inner dimension of which is such that, once mounted, the lower crown 10 comes into sealing interference on the portion of the membrane 5 which is arranged in the region of said narrow portion, so as to create a seal between the inside of the container 2 and the dead volume 11.

With reference to the drawings, the narrow portion 20 has a V-shaped geometry formed by an upper bearing surface 20*a* which is inclined radially towards the inside, and a lower bearing surface 20*b* which is inclined radially towards the outside. In particular, the narrow portion 20 has a minimum inner diameter at the point of the V, in the region of which the lower crown 10 is intended to come into sealing interference with the membrane 5 in order to ensure the seal after mounting is complete.

Advantageously, the upper bearing surface 20*a* extends below the ring 1*b* and thus below the neck 3, whereas the lower bearing surface 20*b* extends above the tube 1*a* and thus above the container 2. Thus, by offsetting the narrow portion 20 under the neck 3, diameter fluctuations in the region of said neck are eliminated, in order to better achieve the sealing interference between the lower crown 10 and said narrow portion, which ensures a good seal after mounting the dispensing member 8.

In particular, it is simpler to produce a narrow portion 20 of this kind when the bottle 1 is produced by blown coextrusion, in particular by providing in the mould a protrusion of a shape complementary to that of the desired narrow portion 20. Furthermore, forming the membrane 5 so as to have an inner layer made of a relatively flexible material, such as polyethylene, makes it possible for the portion of the membrane 5 covering the narrow portion 20 to be able to be deformed by the lower crown 10 and to thus improve the seal.

In addition, the lower crown 10 has an outer diameter which is between the nominal inner diameter of the neck 3 and the minimum inner diameter of the narrow portion 20, which makes it possible for said lower crown to be able to slide easily into said neck during mounting, and to come fully into interference in the region of said narrow portion at the end of said mounting.

In the embodiment shown, the lower crown 10 can be radially deformed between a free mounting state and a compressed state of sealed interference on the narrow portion 20. In particular, the lower crown 10 is deformable and has an annular axial flap 10*a* which is connected to the central well 14 by means of an annular radial platform 10*b*, said annular platform forming a hinge for allowing said flap to pivot between the two states thereof.

Mounting the dispensing member 8 on the bottle 1, in particular after the container has been filled with the fluid product to be dispensed, is described with reference to FIG. 2.

Figure 2A:
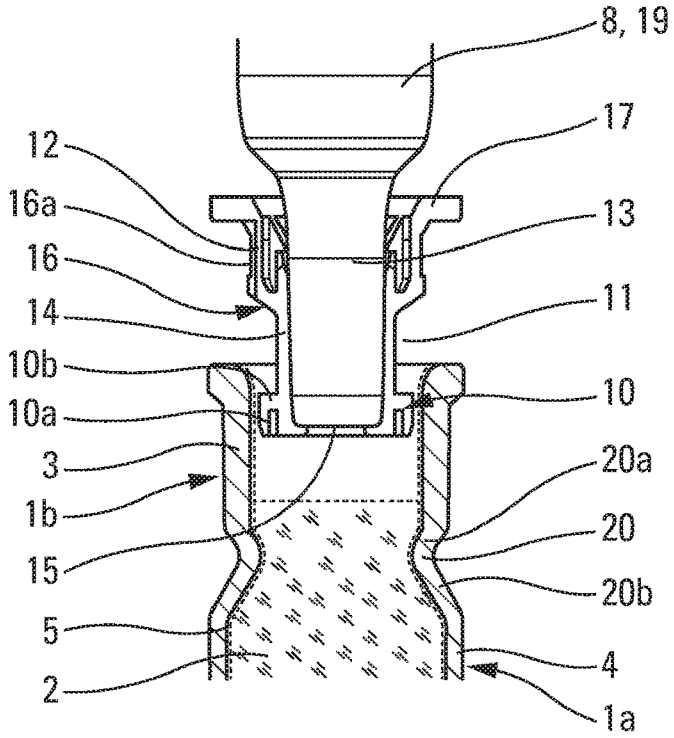
FIGS. 2*a* to 2*d* are partial views showing the mounting of the pump on the neck of the bottle, at the start of mounting (FIG. 2*a*), during mounting (FIG. 2*b*), at the start of the lower sealing interference (FIG. 2*c*), and at the end of the sealed mounting (FIG. 2*d*).
Figure 2B:
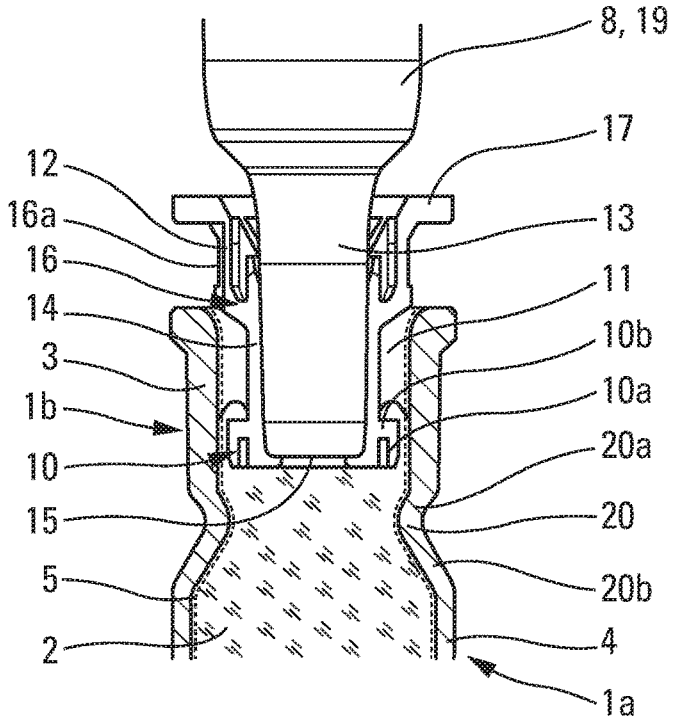

FIGS. 2*a* and 2*b* show that the lower crown 10 is in the free state and can slide easily into the neck 3 without interference, on account of the outer diameter thereof which is smaller than the nominal diameter of said neck. Furthermore, the space between the lower crown 10 and the neck 3 makes it possible for the air present in the container 2, and even for a small amount of excess product contained in said container (FIG. 2*b*), to rise up into the dead volume 11.

Figure 2C:
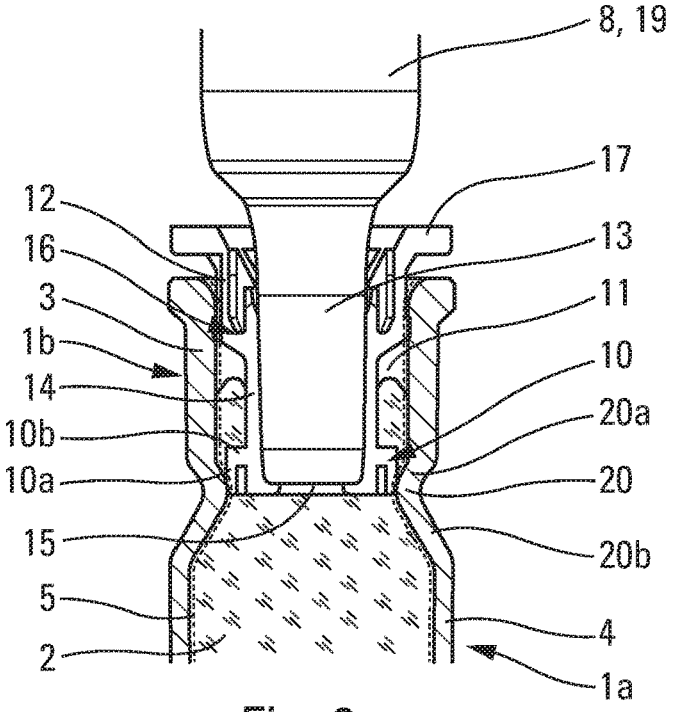

As shown in FIG. 2*c*, once the free edge of the flap 10*a* comes into contact with the narrow portion 20, the lower crown 10 deforms radially, in particular by folding said flap down onto the central well 14 in order to make it possible for said free edge to cross said narrow portion. The venting grooves 16*a* arranged below the upper crown 16 allow air to be evacuated to the outside and prevent pressurisation of the container 2.

Figure 2D:
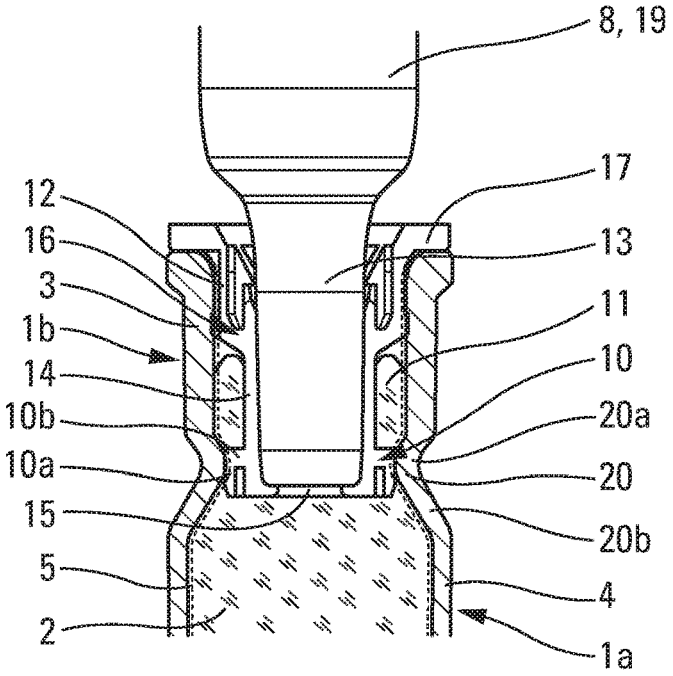

Finally, as shown in FIG. 2*d*, once the upper rim 17 of the collar 12 comes into abutment against the neck 3, the lower crown 10 deforms once again, in particular by means of radially opening the flap 10*a* under the narrow portion 20 in order to achieve its compressed state of sealing interference on said narrow portion. Furthermore, the upper crown 16 comes into sealing interference against the portion of the membrane 5 which is arranged close to the upper opening of the neck 3.

During mounting, the air which is present in the container 2 is evacuated into the dead volume 11, where it remains enclosed upon completion of said mounting. Furthermore, once the air has been completely evacuated, a small amount of product may overflow above the lower crown 10 and remain in the dead volume 11, whereas the sealing interference of the upper crown 16 in the neck 3 ensures that the sealing of the dispensing member 8 in said neck is maintained (FIG. 2*d*). The air contained in the dead volume 11 is therefore no longer in contact with the product packaged in the container 2, so that the bottle 1 is bled of the air which had entered therein during filling thereof, and can be used for dispensing without allowing air to come into contact with the product.

The invention claimed is:

1. System for dispensing a fluid product, comprising a bottle having a container for packaging said product which is surmounted by a neck for accessing said container, said bottle comprising an outer structural wall, on the inner surface of which a membrane is arranged so as to form a flexible pocket for containing said product, and a dispensing member which is intended to be mounted in the neck so as to be in communication with the container in order to be supplied with product, said member being provided with a lower sealing crown which is arranged so as to be able to slide into the neck during mounting of said member, making it possible for excess air and product to be evacuated into an upper dead volume, a collar comprising a central well wherein a lower portion of the dispensing member is positioned within the central well, the collar further supporting the lower sealing crown which is formed on and around a lower end of said central well, said dispensing system being characterised in that the neck has a main outer diameter and a main inner diameter, and the neck comprises a base having a narrow portion of which the inner diameter is smaller than said main inner diameter of the neck and of which the inner dimension is such that, after the dispensing member has been mounted, the lower sealing crown comes into sealing interference on the portion of the membrane which is arranged in the region of said narrow portion so as to create a seal between the inside of said container and said upper dead volume, wherein the dispensing member and the collar including the lower sealing crown each have a lower free end that does not extend below said narrow portion of the neck.

2. Dispensing system according to claim 1, characterised in that the lower sealing crown has an outer diameter which is between said main inner diameter of the neck and an inner diameter of the narrow portion.

3. Dispensing system according to claim 1, characterised in that the lower sealing crown can be radially deformed between a free mounting state and a compressed state of sealing interference on the narrow portion.

4. Dispensing system according to claim 1, characterised in that the dispensing member is provided with an upper crown which seals by interference in the neck, the dead volume being formed in the neck between said upper crown and the lower sealing crown.

5. Dispensing system according to claim 1, characterised in that the membrane is detached from the structural wall, said wall having an opening which allows the pocket to be retracted during dispensing, without take-up of air by the product contained therein.

6. Dispensing system according to claim 1, characterised in that the narrow portion has a V-shaped geometry formed by an upper bearing surface which is inclined radially towards the inside and oriented from the main part of the neck to the central part of the narrow portion, and a lower bearing surface which is inclined radially towards the outside and oriented from the central part of the narrow portion to the bottle.

7. Dispensing system according to claim 1, characterised in that the bottle comprises a cylindrical tube in which the container is formed, said tube being surmounted by an upper ring having a reduced outer dimension smaller than the outer dimension of the cylindrical tube, and in which the neck is formed.

8. Dispensing system according to claim 7, characterised in that the upper bearing surface extends under the ring, the lower bearing surface extending above the tube.

9. Dispensing system according to claim 1, characterised in that the bottle is produced by means of blown coextrusion of the wall and the membrane.

10. Dispensing system according to claim 1, characterised in that the membrane has an inner layer made of polyethylene.

* * * * *